United States Patent [19]

Miyasaka et al.

[11] 4,330,219

[45] May 18, 1982

[54] UPPER COVER FOR LINE PRINTER

[75] Inventors: Masao Miyasaka; Tsuneki Kobayashi, both of Katsuta, Japan

[73] Assignee: Hitachi Koki Company, Limited, Tokyo, Japan

[21] Appl. No.: 174,422

[22] Filed: Aug. 1, 1980

[30] Foreign Application Priority Data

Aug. 4, 1979 [JP] Japan ..... 54-99732

[51] Int. Cl.[3] ..... B41J 29/02; B41J 29/08

[52] U.S. Cl. ..... 400/690.4; 400/691; 16/260

[58] Field of Search ..... 400/691-693, 400/693.1, 690.4; 16/170, 160, DIG. 23

[56] References Cited

U.S. PATENT DOCUMENTS

| | | | |
|---|---|---|---|
| 167,567 | 9/1875 | Redmond | 16/170 |
| 913,429 | 2/1909 | Ralph | 16/170 |
| 1,159,604 | 11/1915 | Soule et al. | 16/DIG. 23 |
| 3,123,196 | 3/1964 | Paone et al. | 400/693.1 |
| 3,191,742 | 6/1965 | Harmon | 400/691 |
| 3,441,976 | 5/1969 | Bellomo | 16/170 |
| 3,499,517 | 3/1970 | Cappolto | 400/693.1 |
| 3,499,642 | 3/1970 | Porter | 16/170 |
| 4,084,291 | 4/1978 | Crowe | 16/170 |

*Primary Examiner*—William Pieprz
*Attorney, Agent, or Firm*—Sughrue, Mion, Zinn, Macpeak and Seas

[57] ABSTRACT

An upper cover for a line printer in which an upper cover hood can be easily opened forwardly to permit full maintenance of the printing mechanism. The upper cover hood is pivotally coupled through a rear hinge holder to a forwardly-extending support member via a balance holder. A balancing mechanism is pivotally coupled at one end to the balance holder. At the front end of the support member a hook member is hingedly attached, the other end of which is adapted to be swung into position and coupled to a pin which is rigidly coupled to a side wall of the upper cover hood. A cushioning packing is disposed along the front edge of the upper cover hood.

5 Claims, 5 Drawing Figures

UPPER COVER FOR LINE PRINTER

BACKGROUND OF THE INVENTION

The present invention relates to an upper cover structure for a line printer. More specifically, the invention relates to a type thereof capable of providing pivotal movement with respect to a console frame of the line printer.

A line printer is generally provided with cover members for housing printing mechanisms. Particularly, an upper cover adapted to cover an upper printing mechanism has a structure capable of being opened or closed with a simple mannual operation in order to exchange the printing paper and/or the ink ribbon. This upper cover which covers the upper printing mechanism serves to prevent danger to the operator and to block noise generated by the printing mechanism and further to provide an electrostatic shielding function as well as to enhance the outer appearance of the printer.

FIG. 1 shows a conventional upper cover structure in which an upper cover hood 1 covers a printing mechanism 2 mounted on a box shaped console frame 4 through shock absorbing members 3. The upper cover hood 1 has a rear bottom end connected to a hinge 5 secured to the console frame 4 by a screw 6 so that the upper cover hood 1 is pivotally movable relative to the console frame 4. The upper cover hood 1 is opened by pivotal movement thereof about the hinge 5 in the clockwise direction in the drawing for exchanging the printing paper or ink ribbon (not shown) or for maintenance of a front side A of the printer.

As is well known, the upper cover hood 1 is relatively heavy, for example the cover has a weight of 7 to 8 kg for small printers and 20 to 30 kg for a large printer. Therefore, a power assisting device or balance mechanism is generally provided in order to allow easy opening or closing of the upper cover hood 1. A spring device, pneumatic or hydraulic cylinder devices and electrical power movers have been used for this purpose. In a conventional upper cover as shown in FIG. 1, at least one balance mechanism 26 utilizing a spring biasing force is employed. In the balance mechanism 26, a balance mechanism guide 12 is secured to an inner surface of a side wall of the cover hood 1 by welding or screws with a shaft 10 slidingly extending through a bore 16 formed in the guide 12. The shaft 10 has a bottom end pivotably secured to a balance mechanism holder 14 by means of a pin 17 with the balance holder 14 secured to the console frame 4 by a screw 15. The shaft 10 has an upper portion provided with a stopper pin 11*a* whose lower surface is in contact with a stop washer 11*b* disposed around the shaft 10.

Further, a lower spring 13*a* is disposed around the shaft 10 and is interposed between a lower surface 12*a* of the guide 12 and a lower stepped portion of the shaft 10 so as to normally urge the upper cover hood 1 upwardly. On the other hand, an upper spring 13*b* is disposed around the shaft 10 and is interposed between the stop washer 11*b* and an upper surface 12*b* of the guide 12. The biasing force of the lower spring 13*a* is slightly smaller than total weight of the upper cover hood 1 so that, during closure of the upper cover, immediate descent of the cover is prevented. The upper spring 13*b* is adapted to stop the cover at a predetermined pivotal locus and to provide a shock absorbing function upon the upper cover hood 1 being opened to the maximum. Moreover, during the opening of the cover hood 1, the biasing force of the spring 13*a* becomes greater than that of the spring 13*b* so that the upper cover hood 1 can be opened with only a small manual force. As shown, the front bottom end of the upper cover hood 1 is attached to a packing 9 which provides a sealing function on the cover as well as absorbing accidental shock due to quick closure of the cover hood 1.

The line printer generally must be maintained and maintenance is carried out at the rear portion B. Therefore, a window 18 is provided at the rear wall of the upper cover hood 1. Normally, the window 18 is closed by a window cover 7 secured to the rear wall by screws 8. To maintain the rear portion of the printer, the window cover 7 is detached from the rear wall to visually observe the rear portion or to allow the inspector to extend his hands or head through the window 18. However, with this construction, the maintenance field is restricted and little light can reach the interior of the printer thereby making the maintenance quite difficult.

The upper cover may be opened by pivotally moving it in the clockwise direction in FIG. 1 in order to let more light in. However, such opening of the cover may degrade maintenance efficiency since the distance between the window 18 and the rear printing mechanism portion is lengthened so that the inspector or operator must extend the upper part of his body through the window 18.

In order to obviate these drawbacks, it has been proposed to detach the upper cover hood 1 from the console frame 4 by releasing the screws 6 and 15. However, even if these screws can be readily removed, it is difficult as a practical matter to remove the cover hood 1 by a single operator since the cover hood 1 tends to be heavy as described above.

SUMMARY OF THE INVENTION

It is therefore, an object of the present invention to overcome the above-mentioned drawbacks and to provide an improved upper cover for use in a line printer.

Another object of this invention is to provide such upper cover capable of providing for easy maintenance for a printing mechanism normally covered by the upper cover.

These and other objects of the invention are attained in accordance with the present invention by providing an upper cover for a line printer including an upper cover hood which is adapted to be opened and closed relative to a console frame. The upper cover hood covers a printing mechanism mounted on the console frame. A balancing mechanism is pivotally mounted to a balance holder which is rigidly coupled to a rear hinge holder which is in turn pivotally supported to the upper cover hood. A support member extends forwardly rigidly coupled to the balance holder. A hook member is pivotally attached to the front end of the support member with the other end of the hook member being adapted to be attached to a pin rigidly coupled to a side wall of the upper cover hood so that the cover may be tilted forwardly and pivotted therearound. A second rear transverse support member can be added which is hingedly connected at one end thereof to the console frame. In this case, the rear hinge holder is pivotally coupled to the rear transverse support member. With the latter construction, the upper cover hood can be opened either forwardly or sideways.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not limitation.

DESCRIPTION OF THE PREFERRED EMBODIMENTS

Figure 1:
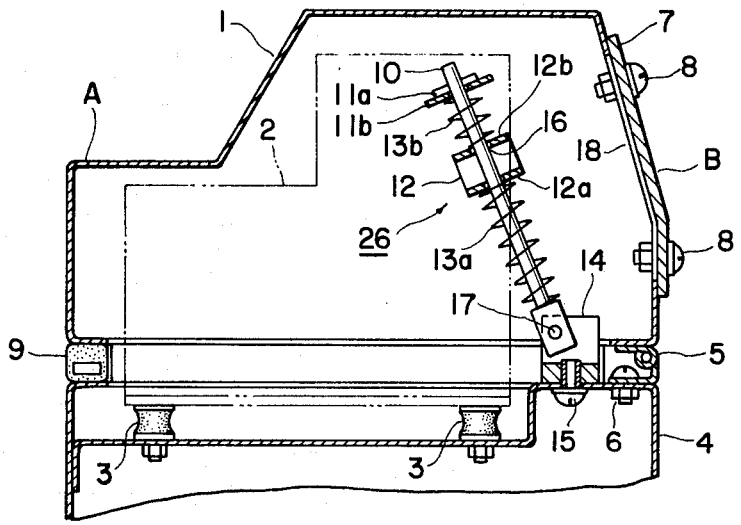
FIG. 1 PRIOR ART
FIG. 1 is a cross-sectional illustration showing a conventional upper cover for a line printer.
Figure 2:
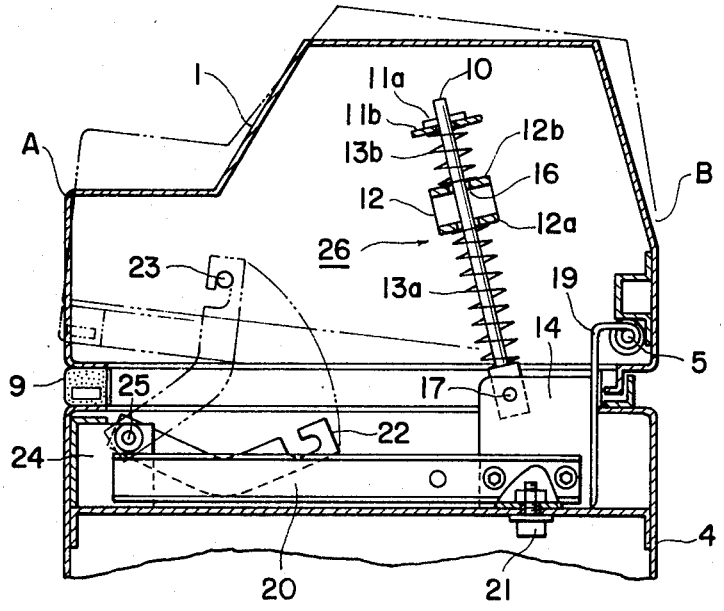
FIG. 2 is a cross-sectional illustration showing an upper cover according to a first embodiment of the present invention.
Figure 3:
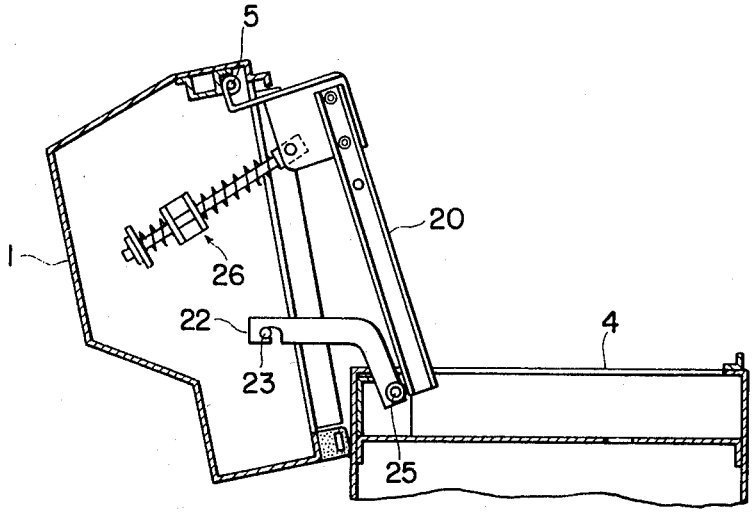
FIGS. 3 and 4 are cross-sectional illustrations of the upper cover of FIG. 2 with its rear portion opened forwardly according to the first embodiment of the present invention.
Figure 4:
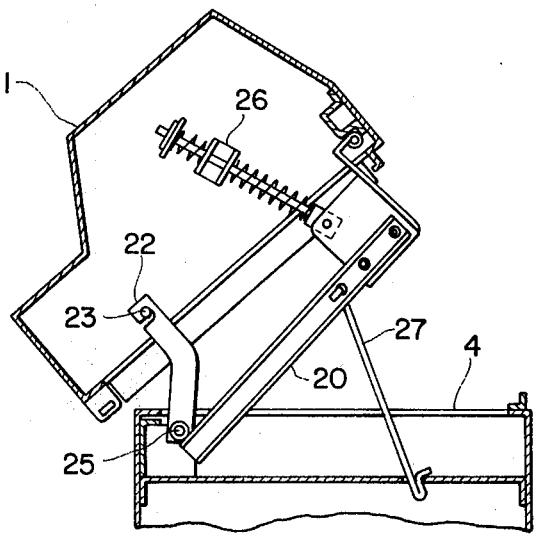

A first embodiment of the present invention is shown in FIGS. 2 to 4 wherein like parts and components are designated by the same reference numerals and characters throughout.

As shown in FIG. 2, a support member 20 adapted to support hinge holders is mounted on a console frame 4 in its stationary position. The support member 20 has a front end pivotally securing a hinge holder 24 attached to the console frame 4 by a front hinge 25 and has a rear end connected by welding or screws to a balance holder 14 detachably secured to the console frame 4 by a screw 21. In this fashion, a balance mechanism 26 is supported by the support member 20 through the balance holder 14.

A hinge holder 19 is connected to a rear side wall of the balance holder 14 and an upper cover hood 1 is pivotally secured to the hinge holder 19 by a cover hinge 5 connected to a lower bottom portion of the upper cover hood 1. With this construction, during opening or lifting of the upper cover 1 from the front, the cover hood 1 is pivoted about the cover hinge 5 in the clockwise direction in FIG. 2 with only small manual force with the aid of the springs 13*a* and 13*b* as shown by two-dot chain line in FIG. 2.

The front hinge 25 pivotally and loosely secures a hook member 22. The hook member 22 can be interlocked with a pin 23 protruding from an inner surface of the upper cover hood upon pivotal movement of the hook member 22 as shown by a dot chain line in FIG. 2. However, during normal operation, the support member 20 is supported by the frame 4 via the balance holder 14, as the lower surface of the holder 14 is lower than the support member 20 in the horizontal position. Also, the hook member 22 is then at the position shown by a solid line in FIG. 2.

For conducting a maintenance of the rear portion of the printing mechanism, the front portion A of the upper cover hood 1 is opened and lifted. In this case, as shown by a dot-chain line in FIG. 2, the hook member 22 is interlocked with the pin 23 after the screw 21 which connects the balance holder 14 to the frame 4 has been released. Thereafter, the rear portion of the upper cover hood 1 may be lifted and pivotted in the counterclockwise direction as shown in FIG. 3 to thereby provide an obstacle-free area around the rear printing mechanism. At the terminating, that is, most fully open position of the cover hood 1, only a cushioning packing 9 contacts the frame 4 so that the frame 4 is not damaged by the cover hood. Further, the maximum opening angle is determined by the locking engagement arrangement between the hook 22 and the pin 23.

If full opening of the cover hood is not required, a stay rod 27 may be employed as shown in FIG. 4 once the cover hood 1 has been lifted to a desired position.

With this embodiment of the present invention, since the rear portion of the upper cover hood 1 can be opened widely, maintenance of the rear printing mechanism may be carried out under brightly lit and obstacle-free conditions. Since the rear portion must often be maintained, such a opening arrangement is extremely advantageous.

Figure 5:
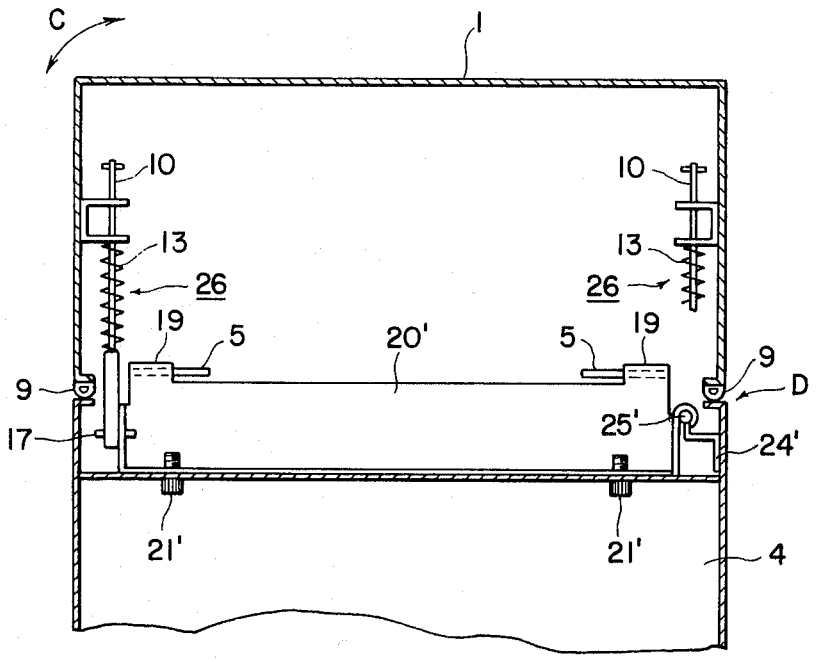
FIG. 5 is a transverse cross-sectional illustration as viewed from a front side showing an upper cover according to a second embodiment of the present invention in which the cover is opened sideways.

A second embodiment of the present invention is shown in FIG. 5 in which an upper cover hood can be opened sideways or laterally along the direction indicated in the drawing by an arrow C. The upper cover hood 1 is pivotably secured at its rear portion to a rear hinge holder 19 of a balance holder 14 by an upper cover hinge 5 so as to provide pivotal movement of the cover hood 1 about the hinge 5 as is provided in the first embodiment. In the second embodiment, a support member 20' is pivotably secured in the transverse direction to a hinge holder 24' through a hinge 25' positioned at the right side D in the drawing. The hinge holder 24' is integrally connected to the frame 4 so that the support member 20' is pivotable with respect to the frame 4. Further, at least one balance mechanism 26 is supported on the support member 20' at a position thereabove so as to biasingly support the upper cover hood 1.

Normally, the support member 20' is secured to the frame 4 at its horizontal position by screws 21'. However, upon release of the screws 21', the upper cover hood 1 is pivotably movable in the direction indicated by the arrow C about the hinge 25' so as to be tiltable relative to the frame 4 and to thereby laterally open the cover hood 1.

According to the present invention, since the support member pivotally secured the upper cover hood at its rear portion through the upper cover hinge and since a balancer mechanism is provided on the support member, the upper cover hood can be pivotted about the upper cover hinge with only a small manual force. Further, since the support member positioned on the frame and supporting the hinge holders is secured pivotably along the front and rearward direction and/or along lateral direction, a large maintaining region is provided whereby the rear printing mechanism of the line printer can be easily maintained in safety and with little manual effort.

What is claimed is:

1. In a line printer of the type having a console frame, a printing mechanism mounted on said console frame, a cover for said printing mechanism and pivotal means for pivotally supporting said cover on said console frame for pivotal movement about plural spaced axes, said pivotal means comprising a support member extending substantially between opposite first and second edges of said cover, first pivot means pivotally connecting said first edge of said cover to one end of said support member, means detachably connecting said one end of said support member to said frame, second pivot means pivotally connecting the opposite end of said support member to said frame, latch means pivoted on said second pivot means and detachably connected to said cover whereby when said latch means is disconnected from said cover and said one end of said support member is connected to said frame said cover can be pivoted about said first pivot means and when said one end of said support member is disconnected from said frame and said latch means is connected to said cover said cover can be pivoted about said second pivot means.

2. A line printer as set forth in claim 1, further comprising balancing means connected between said cover and said one end of said support member for counterbalancing the weight of said cover during opening and closing of said cover.

3. A line printer as set forth in claim 1, further comprising cushioning means secured along said second edge of said cover.

4. A line printer as set forth in claim 1, further comprising a stay rod pivotally connected at one end to said support member and adapted to engage said frame at the other end to maintain said cover and said support member in raised position when pivoted about said second pivot means.

5. A line printer as set forth in claim 1, wherein said support member extends parallel to said first edge of said cover substantially the entire length thereof and further comprising hinge means secured to said frame and said support member with the pivot axis thereof extending perpendicular to said first edge of said cover to provide pivotal movement of said cover in a third direction relative to said frame when said support member is disconnected from said frame.

* * * * *